US007570040B2

(12) United States Patent
Migliavacca

(10) Patent No.: US 7,570,040 B2
(45) Date of Patent: Aug. 4, 2009

(54) ACCURATE VOLTAGE REFERENCE CIRCUIT AND METHOD THEREFOR

(75) Inventor: Paolo Migliavacca, Mauzac (FR)

(73) Assignee: Semiconductor Components Industries, L.L.C., Phoenix, AZ (US)

( * ) Notice: Subject to any disclaimer, the term of this patent is extended or adjusted under 35 U.S.C. 154(b) by 233 days.

(21) Appl. No.: 11/688,136

(22) Filed: Mar. 19, 2007

(65) Prior Publication Data

US 2008/0150511 A1 Jun. 26, 2008

Related U.S. Application Data

(63) Continuation-in-part of application No. 11/613,589, filed on Dec. 20, 2006.

(51) Int. Cl.
*G05F 3/16* (2006.01)

(52) U.S. Cl. ..... 323/316; 323/280; 327/538

(58) Field of Classification Search ..... 323/312–316, 323/280; 327/538–541
See application file for complete search history.

(56) References Cited

U.S. PATENT DOCUMENTS

| | | | | |
|---|---|---|---|---|
| 6,060,874 | A * | 5/2000 | Doorenbos | 323/316 |
| 6,400,213 | B2 * | 6/2002 | Shih et al. | 327/540 |
| 6,946,825 | B2 * | 9/2005 | Tesi | 323/313 |
| 6,972,549 | B2 | 12/2005 | Brass et al. | |

* cited by examiner

*Primary Examiner*—Jessica Han
(74) *Attorney, Agent, or Firm*—Robert F. Hightower

(57) ABSTRACT

In one embodiment, a voltage reference circuit is configured to use two differentially coupled transistors to form a delta Vbe for the voltage reference circuit.

20 Claims, 3 Drawing Sheets

10

ACCURATE VOLTAGE REFERENCE CIRCUIT AND METHOD THEREFOR

The present application is a continuation-in-part of prior U.S. application Ser. No. 11/613,589, filed on 20 Dec. 2006 having a common inventor and common assignee, which is hereby incorporated by reference, and priority thereto for common subject matter is hereby claimed.

BACKGROUND OF THE INVENTION

The present invention relates, in general, to electronics, and more particularly, to methods of forming semiconductor devices and structure.

In the past, the electronics industry utilized various methods and structures to build voltage reference circuits. The voltage reference circuits generally were used to supply a stable reference voltage for use by other circuits such as a comparator circuit. One commonly used design technique to form the voltage reference circuits used a bandgap reference as a portion of the voltage reference circuit. One design parameter for the prior voltage reference circuits was to reduce variations in the reference voltage that resulted from variations in the value of the input voltage that was used to operate the voltage reference circuit. This is sometimes referred to as power supply rejection. The ratio of the change of the input voltage to the change on reference voltage was referred to as the power supply rejection ratio (PSSR). One example of a prior voltage reference circuit was disclosed in U.S. Pat. No. 6,972,549 that issued to Brass et al. on Dec. 6, 2005. However, such prior voltage reference circuits did not provide sufficient power supply rejection.

Accordingly, it is desirable to have a voltage reference circuit that has improved power supply rejection.

For simplicity and clarity of the illustration, elements in the figures are not necessarily to scale, and the same reference numbers in different figures denote the same elements. Additionally, descriptions and details of well-known steps and elements are omitted for simplicity of the description. As used herein current carrying electrode means an element of a device that carries current through the device such as a source or a drain of an MOS transistor or an emitter or a collector of a bipolar transistor or a cathode or anode of a diode, and a control electrode means an element of the device that controls current through the device such as a gate of an MOS transistor or a base of a bipolar transistor. Although the devices are explained herein as certain N-channel or P-Channel devices, a person of ordinary skill in the art will appreciate that complementary devices are also possible in accordance with the present invention. It will be appreciated by those skilled in the art that the words during, while, and when as used herein are not exact terms that mean an action takes place instantly upon an initiating action but that there may be some small but reasonable delay, such as a propagation delay, between the reaction that is initiated by the initial action.

DETAILED DESCRIPTION OF THE DRAWINGS

Figure 1:
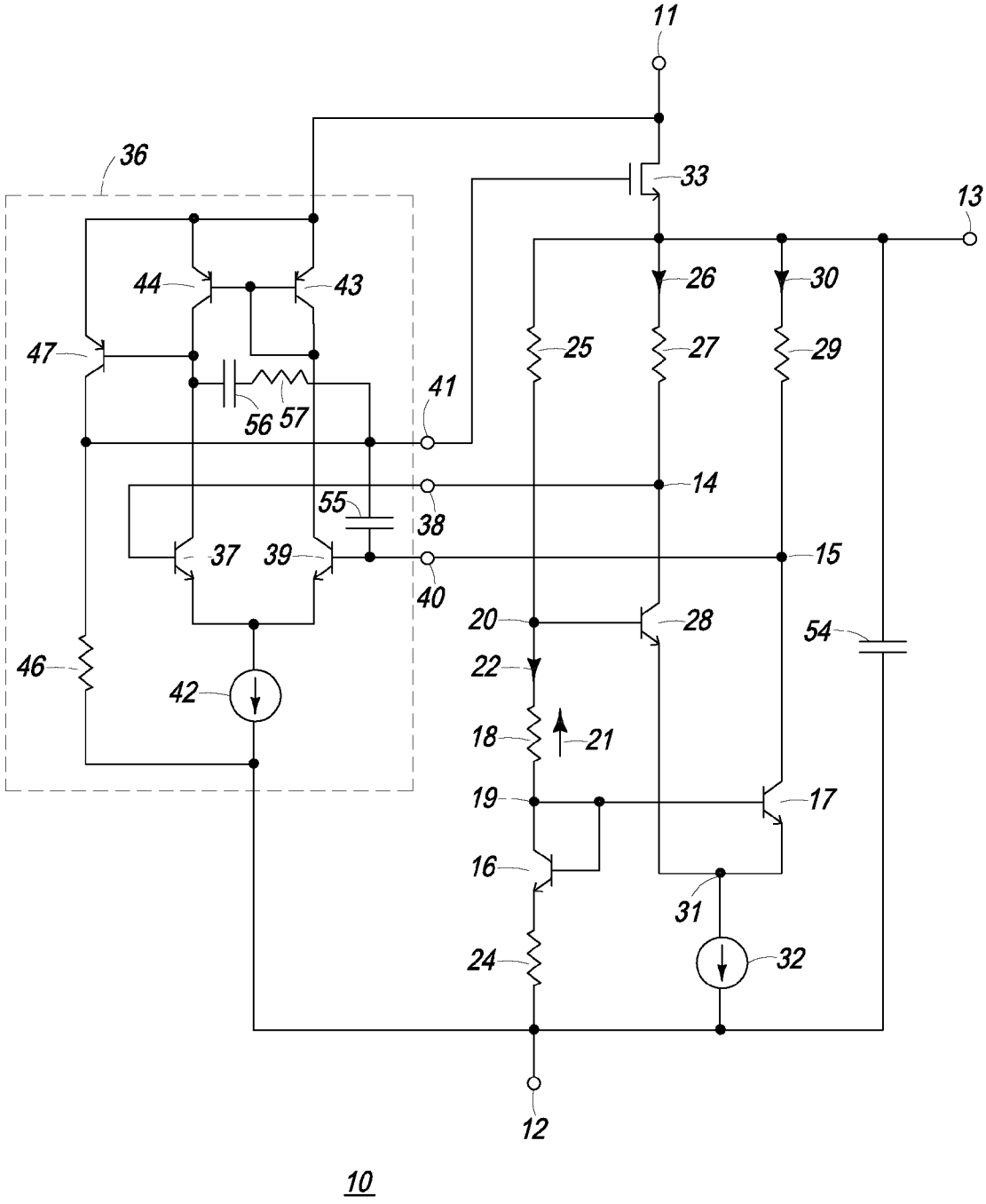
FIG. 1 schematically illustrates an embodiment of a portion of a voltage reference circuit in accordance with the present invention.

FIG. 1 schematically illustrates a portion of an embodiment of a voltage reference circuit 10 that has improved power supply rejection. Voltage reference circuit 10 receives an input voltage to operate circuit 10 between an input terminal 11 and a common return terminal 12 and forms a stable reference voltage on an output 13 of circuit 10. As will be seen further hereinafter, circuit 10 utilizes two transistors coupled as a differential pair that form a delta Vbe of a bandgap reference portion of circuit 10. Circuit 10 includes NPN bipolar transistors 17 and 28 that are connected in a differential pair. A current source 32 and load resistors 27 and 29 usually are connected to transistors 17 and 28. A control loop of circuit 10 includes an operational amplifier 36 and a control transistor 33. Circuit 10 also includes series connected resistors 18, 24, and 25 in addition to a diode coupled transistor 16 that is connected in series with resistors 18, 24, and 25. Operational amplifier 36 includes a signal rejection circuit that includes a capacitor 56 and an optional resistor 57, an open loop compensation capacitor 55, differentially coupled transistors 37 and 39 in addition to a current source 42, load transistors 43 and 44, and a second stage with a transistor 47 and a resistor 46 that assist in forming the operational amplifier. The signal rejection circuit of capacitor 56 and an optional resistor 57 improves the PSRR for frequencies between about one hundred hertz to about one hundred KiloHertz (100 Hz-100 KHz). An input 40 of amplifier 36 provides an input signal to transistor 39 and an input 38 provides an input signal to transistor 37. An output 41 of amplifier 36 is connected to control transistor 33.

Amplifier 36 receives the value of the collector voltage of transistors 17 and 28 that are formed at respective nodes 14 and 15. The control loop of amplifier 36 and transistor 33 are configured to regulate the value of the voltage at nodes 14 and 15 to be substantially equal. In the preferred embodiment, resistors 27 and 29 have equal values so that the value of respective currents 26 and 30 through resistors 27 and 29 are substantially equal. Those skilled in the art will appreciate that the value of resistors 27 and 29 are also chosen to provide the desired open loop gain for amplifier 36 and transistor 33. Thus, the value of currents 26 and 30 through respective transistors 28 and 17 are also equal.

Transistors 17 and 28 are formed to have active areas that have different sizes so that the Vbe of transistors 17 and 28 are not the same value. In the preferred embodiment, transistor 17 has an active area that is about eight (8) times larger than the active area of transistor 28 so that in operation the value of the Vbe of transistor 17 is approximately ten percent (10%) less than the value of the Vbe of transistor 28. Also, since transistors 17 and 28 have substantially equal current values but different active area sizes the Vbe of transistor 17 has to be less than the Vbe of transistor 28. Current source 32 causes the sum of currents 26 and 30 to be substantially constant. Resistor 18 is connected between the base of transistor 28 and the base of transistor 17 to receive a voltage that is approximately the difference between the Vbe of transistor 28 and the Vbe of transistor 17. This voltage difference is often referred to as the delta Vbe of the bandgap reference circuit formed by transistors 17 and 28. Thus, a voltage 21 that is developed across resistor 18 is equal to the delta Vbe. The delta Vbe received by resistor 18 causes a current 22 to flow through resistor 18. Thus, the value of current 22 is representative of the delta Vbe. The current mirror configuration between transistors 16 and 17 set the polarity and the value of the voltage at a node 31.

Current 22 flows through transistor 16, resistor 24, and resistors 25 and 18. Consequently, the value of the reference voltage formed on output 13 is substantially equal to:

$$\begin{aligned} Vref &= 16Vbe + deltaVbe + ((deltaVbe/R18)(R24 + R25)) \\ &= 16Vbe + ((deltaVbe/R18)\ (R24 + R25 + R18)). \end{aligned}$$

where;

Vref—the output voltage on output 13,

16Vbe—the Vbe of transistor 16, deltaVbe—the delta Vbe,

R18—the value of resistor 18,

R24—the value of resistor 24, and

R25—the value of resistor 25.

Configuring amplifier 36 to receive the collector voltage of transistors 17 and 28 that form the delta Vbe minimizes the variations of delta Vbe that result from variations of the input signals to amplifier 36 as the value of the input voltage on input terminal 11 varies. This minimizes variations in the output voltage as the input voltage varies. If the input voltage changes, any changes in the value of the input signals received by amplifier 36 has little effect on the delta Vbe value. Additionally, connecting the inputs of amplifier 36 to the collectors of transistors 17 and 28 improves the accuracy of the reference voltage formed on output 13. For example, if amplifier 36 has some input offset, the offset is reflected on the collectors of transistors 17 and 28 but has very little effect on the value of the delta Vbe formed across resistor 21. It is believed that this configuration improves the accuracy of the value of the reference voltage by two to three (2-3) times over the prior art.

The parasitic base-collector junction capacitance of transistor 39 forms a zero in the PSRR transfer function that can cause high variations in the output voltage resulting from high frequency changes in the input voltage received on input 11. The zero is related to the impedance seen by the collector of transistor 39 when output 41 of differential amplifier 36 and inputs 38 and 40 are grounded which is given by:

$$Z39=2*Ri47*gm47*Ro47.$$

where;

Z39—the impedance seen by the collector of transistor 39,

Ro47—output impedance of transistor 47, gm47—transconductance of transistor 47, and Ri47—the impedance looking into the base of transistor 47.

The frequency of the zero is given by:

$$Fz=\tfrac{1}{2}\pi*Z39*Ccb$$

Where;

Fz—the frequency of the zero, and

Ccb=base-collector junction capacitance of transistor 39.

Capacitor 56 is chosen to form a pole in the PSRR transfer function that cancels the effect of the zero formed by the parasitic base-collector junction capacitance of transistor 39 and the impedance Z39. The pole is related to the impedance seen by the collector of transistor 37 when power supply 11 and inputs 38 and 40 of differential amplifier are grounded. The impedance is given by:

$$P37=Ri47*gm47*Ro47$$

where;

P37—the impedance seen by the collector of transistor 37.

The frequency of the pole is given by:

$$Fp=\tfrac{1}{2}\pi*P37*C56$$

Where;

Fp—the frequency of the pole, and

C56—the value of capacitor 56.

To cancel the zero, the frequency of the pole has to be equal to the frequency of the zero:

$$Fz=Fp$$

That gives:

$$C56=2*Ccb$$

As shown by the above equations, the value of capacitor 56 is chosen to as close a possible to twice the value of the parasitic collector-base capacitance of transistor 39. Capacitor 56 may also be formed as a junction capacitor so that the capacitances track over temperature and process variations. Resistor 57 is optional and may be omitted. Resistor 57 may be used to improve the PSRR for at or above about one hundred kilo-hertz (100 KHz). If resistor 57 is included, the value of resistor 57 is chosen to about 200 KOhm. The signal rejection circuit of capacitor 56 and an optional resistor 57 improves the PSRR by a factor of about one hundred to one thousand (100-1000) for frequencies between about one hundred Hertz to about one hundred Kilo-Hertz (100 Hz-100 KHz). In one example embodiment, the PSRR was improved by about forty decibels (40 db).

Capacitor 55 is used to form a pole in the open loop gain transfer function for the reference voltage on output 13. Capacitor 55 does not appear in the transfer function for the PSRR because capacitor 55 does not affect the collector of either of transistors 37 or 39. Capacitor 54 functions as an output filter that improves the PSRR at frequencies greater than about one hundred Kilo-Hertz (100 KHz).

The value of the current supplied by transistor 33 to a load (not shown) on output 13 depends on the size of transistor 33 and the value of the input voltage on input terminal 11. The load connected to output 13 may be a passive load or an active load such as a transistor that is a portion of another electrical circuit. If transistor 33 is large, transistor 33 can provide a large current at low values of the input voltage. In one example embodiment, transistor 33 could supply up to seven hundred milli-amperes (700 ma.) at input voltage values as low as about 2.0 volts.

In order to facilitate this functionality for circuit 10, a collector of transistor 17 is commonly connected to node 15 and a first terminal of resistor 29 which has a second terminal connected to output 13. An emitter of transistor 17 is commonly connected to a first terminal of current source 32 and an emitter of transistor 28. A collector of transistor 28 is commonly connected to node 14 and a first terminal of resistor 27 which has a second terminal connected to output 13. A base of transistor 17 is commonly connected to a base and a collector of transistor 16. An emitter of transistor 16 is connected to a first terminal of resistor 24 which has a second terminal connected to return terminal 12. A second terminal of current source 32 is connected to return terminal 12. The collector of transistor 16 is connected to node 19 and to a first terminal of resistor 18. A second terminal of resistor 18 is commonly connected to a node 20, the base of transistor 28, and a first terminal of resistor 25. Resistor 25 has a second terminal connected to output 13. Input 38 of amplifier 36 is connected to node 14 and input 40 of amplifier 36 is connected to node 15. Output 41 of amplifier 36 is connected to a gate of transistor 33. A base of transistor 39 is connected to input 40 and to a first terminal of capacitor 55, and an emitter is connected to a first terminal of current source 42. A second terminal of capacitor 55 is connected to output 41. A second terminal of source 42 is connected to return terminal 12. A collector and a base of a transistor 43 are connected to a collector of transistor 39, and an emitter is connected to input terminal 11. A base of transistor 37 is connected to input 38, and an emitter is connected to the first terminal of current source 42. A base of a transistor 44 is connected to the base of transistor 43, a collector is connected to the collector of transistor 37, and an emitter is connected to input terminal 11. A base of a transistor 47 is connected to the collector of transistor 44, an emitter is connected to input terminal 11, and a collector is connected to output 41 and a first terminal of a resistor 46. A second terminal of resistor 46 is connected to return terminal 12. A source of transistor 33 is connected to output 13 and a drain is connected to input terminal 11. A first terminal of resistor 57 is connected to output 41 and a second terminal is connected to a first terminal of capacitor 56. A second terminal of capacitor 56 is connected to the collector of transistor 37.

Figure 2:
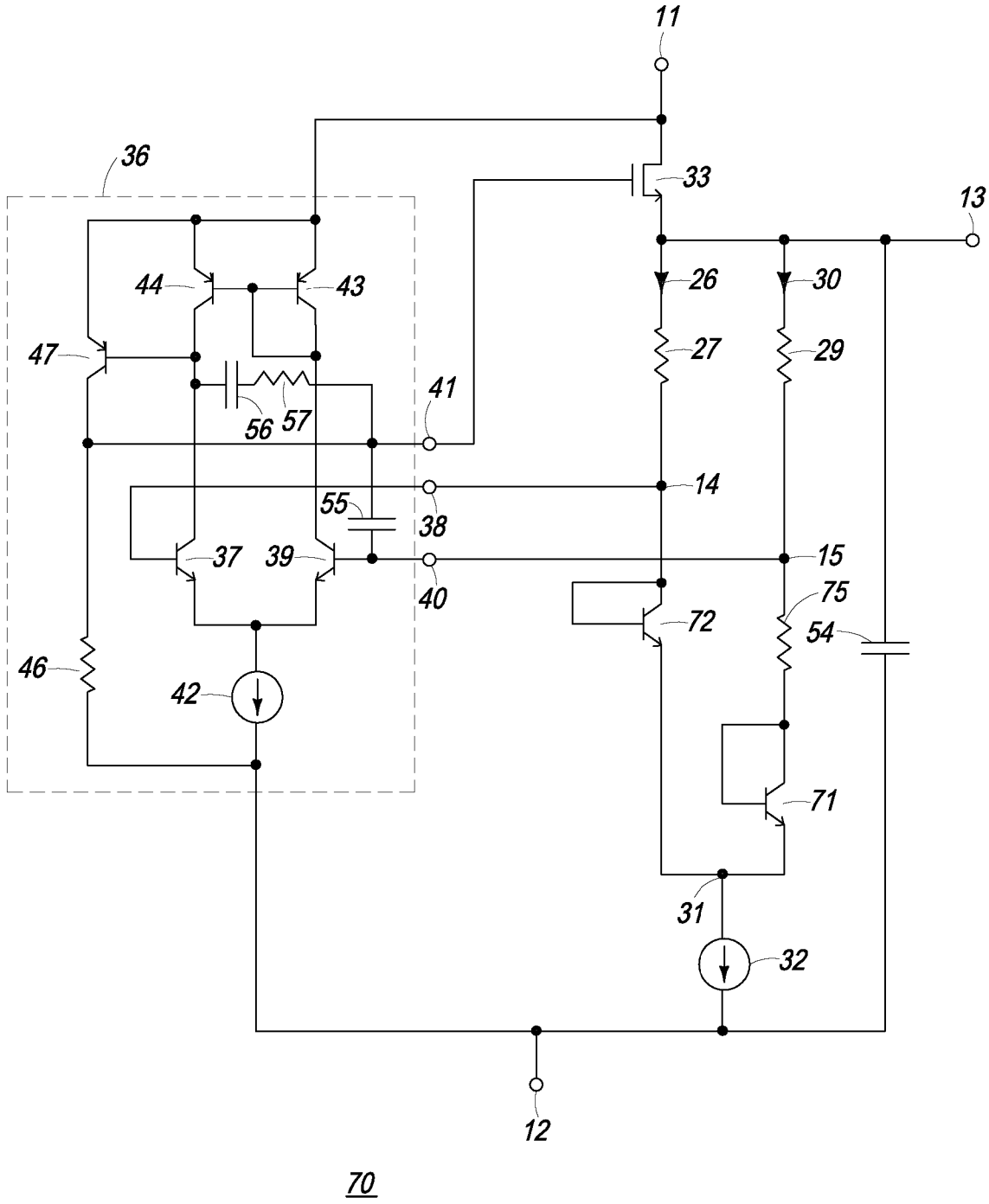
FIG. 2 schematically illustrates an embodiment of a portion of another voltage reference circuit that is an alternate embodiment of the voltage reference circuit of FIG. 1 in accordance with the present invention.

FIG. 2 schematically illustrates a portion of an embodiment of a voltage reference circuit 70 that is an alternate embodiment of circuit 10 that was explained in the description of FIG. 1. Circuit 70 is similar to circuit 10 except that series connected resistors 18, 24, and 25 and transistor 16 are omitted. Also, transistors 17 and 28 are replaced by diode connected transistor 71 and 72, respectively. A resistor 75 is added in series resistor 29.

Figure 3:
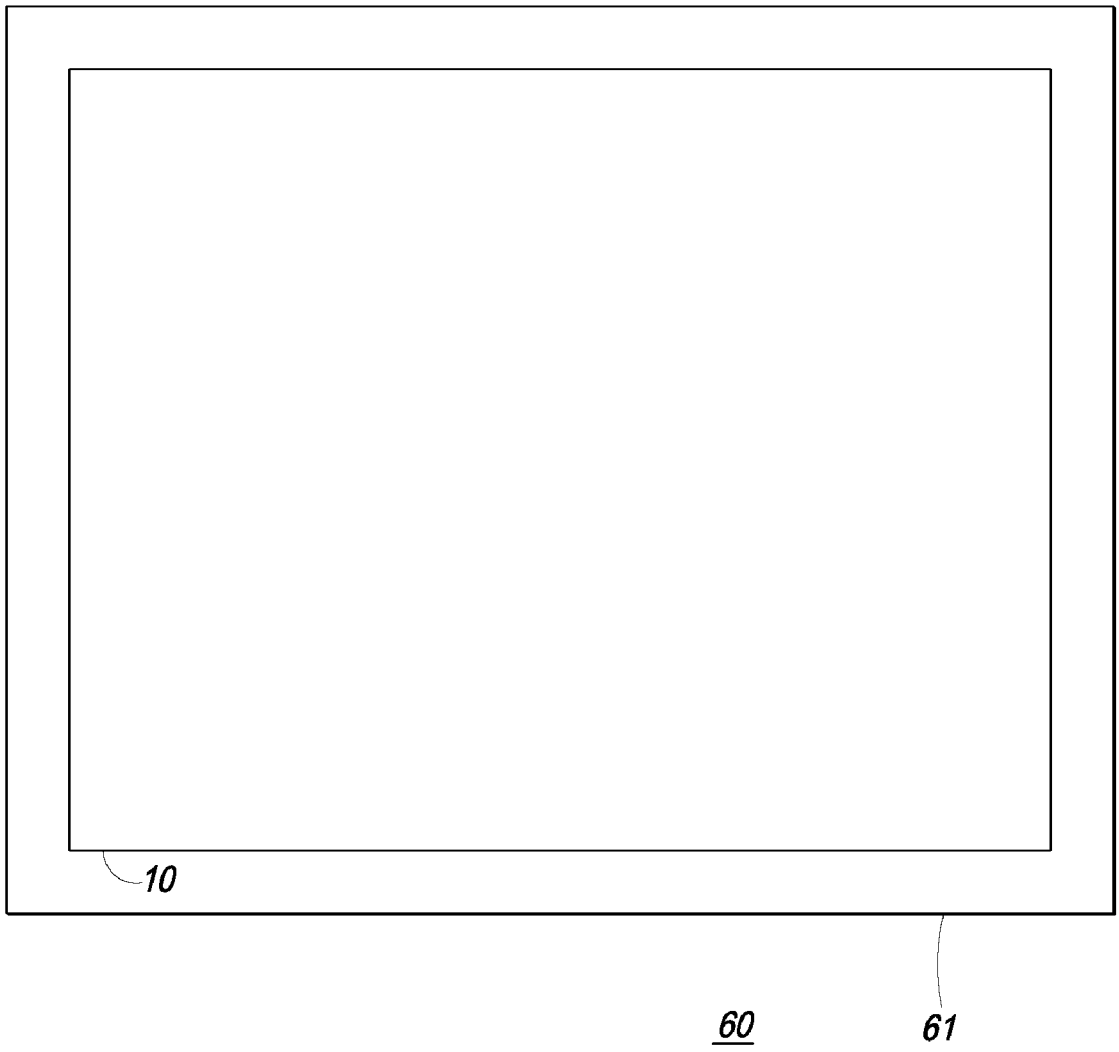
FIG. 3 schematically illustrates an enlarged plan view of a semiconductor device that includes the voltage reference circuit of FIG. 1 in accordance with the present invention.

FIG. 3 schematically illustrates an enlarged plan view of a portion of an embodiment of a semiconductor device or integrated circuit 60 that is formed on a semiconductor die 61. Circuit 10 is formed on die 61. Circuit 70 may be formed on die 61 instead of circuit 10. Die 61 may also include other circuits that are not shown in FIG. 3 for simplicity of the drawing. Circuit 10 and device or integrated circuit 60 are formed on die 61 by semiconductor manufacturing techniques that are well known to those skilled in the art.

In view of all of the above, it is evident that a novel device and method is disclosed. Included, among other features, is using a pair of differentially coupled transistors to form a delta Vbe generation circuit. Using the differentially coupled transistors improves the power supply rejection of the voltage reference circuit. Using capacitor 56 improves the PSRR of the voltage reference circuit.

While the subject matter of the invention is described with specific preferred embodiments, it is evident that many alternatives and variations will be apparent to those skilled in the semiconductor arts. For example, current sources 32 and 42 may be each be replaced by a resistor. Additionally, resistors 27 and 29 may be replaced by current sources. Additionally, transistors 37 and 39 may be MOS transistors and amplifier 36 may be an MOS or CMOS amplifier instead of a bipolar amplifier. Additionally, the word "connected" is used throughout for clarity of the description, however, it is intended to have the same meaning as the word "coupled". Accordingly, "connected" should be interpreted as including either a direct connection or an indirect connection.

The invention claimed is:

1. A voltage reference circuit comprising:

a first transistor having a first active area, a first current carrying electrode, a second current carrying electrode, and a control electrode wherein the first active area is configured to form a first Vbe;

a second transistor having a first current carrying electrode, a second current carrying electrode, a control electrode, and a second active area that is smaller than the first active area wherein the second active area is configured to form a second Vbe that is greater than the first Vbe;

a first resistor coupled to receive a difference between the first Vbe and the second Vbe, the first resistor having first and second terminals;

an operational amplifier having a first input coupled to the first current carrying electrode of the first transistor, a second input coupled to the first current carrying electrode of the second transistor, an output, and a third transistor coupled to receive signals from the second input; and a capacitor having a first terminal coupled to the output of the operational amplifier and a second terminal coupled to a current carrying electrode of the third transistor.

2. The voltage reference circuit of claim 1 wherein neither the first transistor nor the second transistor are coupled in a diode configuration.

3. The voltage reference circuit of claim 1 further including a fourth transistor coupled in a diode configuration and having a control electrode commonly coupled to a first current carrying electrode of the fourth transistor, the control electrode of the first transistor, and the first terminal of the first resistor, the fourth transistor having a second current carrying electrode.

4. The voltage reference circuit of claim 3 further including a second resistor coupled in series with the first resistor, and a third resistor coupled in series with the first resistor.

5. The voltage reference circuit of claim 4 wherein the first, second, third, and fourth transistors are bipolar transistors.

6. The voltage reference circuit of claim 1 further including a current source coupled to the second current carrying electrode of the first transistor and to the second current carrying electrode of the second transistor.

7. The voltage reference circuit of claim 1 further including another capacitor coupled from the output of the operation amplifier to the first input of the operational amplifier.

8. The voltage reference circuit of claim 1 further including a second resistor coupled between the first current carrying electrode of the first transistor and an output of the voltage reference circuit and including a third resistor coupled between the first current carrying electrode of the second transistor and the output of the voltage reference circuit.

9. The voltage reference circuit of claim 1 further including a control transistor coupled to receive an output of the operational amplifier and control a current to flow through the first and second transistors.

10. The voltage reference circuit of claim 1 wherein the first resistor is coupled between the control electrode of the first transistor and the control electrode of the second transistor.

11. A method of forming a voltage reference circuit comprising:

coupling a first transistor and a second transistor in a differential pair configuration; and configuring the first transistor to have a first Vbe that is less than a second Vbe of the second transistor;

coupling an operational amplifier to receive signals from the first transistor and the second transistor; and coupling a capacitor between an output of the operational amplifier and a current carrying electrode of a transistor of a differential pair of the operational amplifier.

12. The method of claim 11 further including coupling a first resistor to receive the first Vbe and the second Vbe and form a first current that is representative of a difference between the first Vbe and the second Vbe.

13. The method of claim 12 further including coupling a second resistor in series with the first resistor to receive the first current.

14. The method of claim 13 further including coupling a third resistor in series with the first resistor to receive the first current and coupling a third transistor in a diode configuration and in series with the first resistor.

15. The method of claim 11 further including coupling a control electrode of a third transistor to a control electrode of the first transistor.

16. The method of claim 11 wherein coupling the first transistor and the second transistor in the differential pair configuration includes coupling a current source to form a bias current through the first and second transistors.

17. The method of claim 11 wherein coupling the first transistor and the second transistor in the differential pair configuration includes coupling a first resistor between the first transistor and an output of the voltage reference circuit and coupling a second resistor between the second transistor and the output of the voltage reference circuit.

18. A method of forming a voltage reference circuit comprising:

coupling a first transistor and a second transistor in a differential pair configuration;

configuring the first transistor to have a first active area that is larger than a second active area of the second transistor;

coupling an operational amplifier to receive signals from the first transistor and the second transistor; and coupling a capacitor between an output of the operational amplifier and a current carrying electrode of a transistor of a differential pair of the operational amplifier.

19. The method of claim 18 wherein configuring the first transistor to have the first active area that is larger than the second active area includes configuring the first transistor to form a first Vbe that is less than a second Vbe of the second transistor and coupling a current source to form a bias current through the first and second transistors.

20. The method of claim 19 further including coupling a first resistor to receive the first Vbe and the second Vbe and form a first current that is representative of a difference between the first Vbe and the second Vbe.

* * * * *